US006201523B1

(12) United States Patent
Akiyama et al.

(10) Patent No.: US 6,201,523 B1
(45) Date of Patent: Mar. 13, 2001

(54) FLAT PANEL DISPLAY DEVICE

(75) Inventors: Ichiro Akiyama; Satoru Yamanaka, both of Saitama (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/276,490

(22) Filed: Mar. 25, 1999

(30) Foreign Application Priority Data

Mar. 26, 1998 (JP) ..... 10-079816

(51) Int. Cl.[7] ..... G09G 3/36

(52) U.S. Cl. ..... 345/96; 345/211; 345/213; 345/205; 345/206

(58) Field of Search ..... 345/87, 92, 96, 345/205, 206, 211, 212, 213

(56) References Cited

U.S. PATENT DOCUMENTS 5,438,342 * 8/1995 Yamaguchi ..... 345/58
5,489,910 * 2/1996 Kuwata et al. ..... 345/212
5,926,160 * 7/1999 Furuya ..... 345/98
6,025,835 * 2/2000 Aoki et at. ..... 345/204
6,049,321 * 4/2000 Sasaki ..... 345/99
6,091,391 * 7/2000 Ling et al. ..... 345/98
6,111,559 * 8/2000 Motomura et al. ..... 345/102
6,115,018 * 9/2000 Okumura et al. ..... 345/95

* cited by examiner

*Primary Examiner*—Richard Hjerpe
*Assistant Examiner*—Kimnhung Nguyen
(74) *Attorney, Agent, or Firm*—Oblon, Spivak, McClelland, Maier & Neustadt, P.C.

(57) ABSTRACT

A positive polarity D/A converter 11 and a negative polarity D/A converter 12 are formed of an IC chip having the same structure and the same breakdown voltage respectively. When a horizontal clock signal CKH is in a non-conformity state, a clock monitoring circuit 124 contained in the negative polarity D/A converter 12 selects inputs of switch circuits 113, 123 such that outputs of the positive polarity D/A converter 11 and the negative polarity D/A converter 12 can be set to the same potential as an external input. Accordingly, since an output of a D/A converter 10 and an output of a common circuit 13 become a substantially identical potential, application of a DC voltage to a liquid crystal layer can be prevented. Alternatively, the same operation as the above can be achieved by monitoring the horizontal clock signal CKH by using a clock monitoring circuit 114 of the positive polarity D/A converter 11.

15 Claims, 10 Drawing Sheets

3
24(12×2) VIDEO SIGNAL (ANALOG)
Vpol
STH
CKH
Q
B256
G256
R256
B257
G249
R249
Dm-(n-1)
Dm-n
PN
115
116
117
125
126
127
128
120
129
134
109
108
118
119
130
110
111

FIG.7

L1 (24 LINES)

| POL=0 | POL=1 |
|---|---|
| L1P1 | L1N1 |
| L1N1 | L1P1 |
| L1P2 | L1N2 |
| L1N2 | L1P2 |
| L1P3 | L1N3 |
| L1N3 | L1P3 |
| L1P4 | L1N4 |
| L1N4 | L1P4 |
| L1P5 | L1N5 |
| L1N5 | L1P5 |
| L1P6 | L1N6 |
| L1N6 | L1P6 |
| L1P7 | L1N7 |
| L1N7 | L1P7 |
| L1P8 | L1N8 |
| L1N8 | L1P8 |
| L1P9 | L1N9 |
| L1N9 | L1P9 |
| L1P10 | L1N10 |
| L1N10 | L1P10 |
| L1P11 | L1N11 |
| L1N11 | L1P11 |
| L1P12 | L1N12 |
| L1N12 | L1P12 |

| BLOCK 1 | 2 | 3 | 4 | 0 | 31 | 32 |
|---|---|---|---|---|---|---|
| R 249 | R 241 | R 233 | R 225 | R 17 | R 9 | R 1 |
| G 249 | G 241 | G 233 | G 225 | G 17 | G 9 | G 1 |
| B 249 | B 241 | B 233 | B 225 | B 17 | B 9 | B 1 |
| R 250 | R 242 | R 234 | R 226 | R 18 | R 10 | R 2 |
| G 250 | G 242 | G 234 | G 226 | G 18 | G 10 | G 2 |
| B 250 | B 242 | B 234 | B 226 | B 18 | B 10 | B 2 |
| R 251 | R 243 | R 235 | R 227 | R 19 | R 11 | R 3 |
| G 251 | G 243 | G 235 | G 227 | G 19 | G 11 | G 3 |
| B 251 | B 243 | B 235 | B 227 | B 19 | B 11 | B 3 |
| R 252 | R 244 | R 236 | R 228 | R 20 | R 12 | R 4 |
| G 252 | G 244 | G 236 | G 228 | G 20 | G 12 | G 4 |
| B 252 | B 244 | B 236 | B 228 | B 20 | B 12 | B 4 |
| R 253 | R 245 | R 237 | R 229 | R 21 | R 13 | R 5 |
| G 253 | G 245 | G 237 | G 229 | G 21 | G 13 | G 5 |
| B 253 | B 245 | B 237 | B 229 | B 21 | B 13 | B 5 |
| R 254 | R 246 | R 238 | R 230 | R 22 | R 14 | R 6 |
| G 254 | G 246 | G 238 | G 230 | G 22 | G 14 | G 6 |
| B 254 | B 246 | B 238 | B 230 | B 22 | B 14 | B 6 |
| R 255 | R 247 | R 239 | R 231 | R 23 | R 15 | R 7 |
| G 255 | G 247 | G 239 | G 231 | G 23 | G 15 | G 7 |
| B 255 | B 247 | B 239 | B 231 | B 23 | B 15 | B 7 |
| R 256 | R 248 | R 240 | R 232 | R 24 | R 16 | R 8 |
| G 256 | G 248 | G 240 | G 232 | G 24 | G 16 | G 8 |
| B 256 | B 248 | B 240 | B 232 | B 24 | B 16 | B 8 |

L2 (24 LINES)

| POL=0 | POL=1 |
|---|---|
| L1P1 | L1N1 |
| L1N1 | L1P1 |
| L1P2 | L1N2 |
| L1N2 | L1P2 |
| L1P3 | L1N3 |
| • | • |

| BLOCK 1 | 2 | 3 | 4 | | 31 | 32 |
|---|---|---|---|---|---|---|
| R 257 | R 265 | R 273 | R 281 | R | R 497 | R 505 |
| G 257 | G 265 | G 273 | G 281 | G | G 497 | G 506 |
| B 257 | B 265 | B 273 | B 281 | B | B 497 | B 506 |
| R 258 | R 266 | R 274 | R 282 | R | R 497 | R 507 |
| G 258 | G 266 | G 274 | G 282 | G | G 497 | G 507 |
| • | • | • | • | • | • | • |

R1 (24 LINES)

| POL=0 | POL=1 |
|---|---|
| R1P1 | R1N1 |
| R1N1 | R1P1 |
| R1P2 | R1N2 |
| R1N2 | R1P2 |
| R1P3 | R1N3 |
| • | • |

| BLOCK 1 | 2 | 3 | 4 | 5 | 31 | 32 |
|---|---|---|---|---|---|---|
| R 761 | R 753 | R 745 | R 737 | R 729 | 521 | R 513 |
| G 761 | G 753 | G 745 | G 737 | G 729 | 521 | G 513 |
| B 761 | B 753 | B 745 | B 737 | B 729 | 521 | B 513 |
| R 762 | R 754 | R 746 | R 738 | R 730 | 522 | R 514 |
| G 762 | G 754 | G 746 | G 738 | G 730 | 522 | G 514 |
| • | • | • | • | • | • | • |

R2 (24 LINES)

| POL=0 | POL=1 |
|---|---|
| R1P1 | R1N1 |
| R1N1 | R1P1 |
| R1P2 | R1N2 |
| R1N2 | R1P2 |
| R1P3 | R1N3 |
| • | • |

| BLOCK 1 | 2 | 3 | 4 | 5 | 31 | 32 |
|---|---|---|---|---|---|---|
| R 769 | R 777 | R 785 | R 793 | R | R 1009 | R 1017 |
| G 769 | G 777 | G 785 | G 793 | G | G 1009 | G 1017 |
| B 769 | B 777 | B 785 | B 793 | B | B 1009 | B 1017 |
| R 770 | R 778 | R 785 | R 794 | | R 1010 | R 1018 |
| G 770 | G 778 | G 785 | G 794 | | G 1010 | G 1018 |
| • | • | • | • | • | • | • |

FLAT PANEL DISPLAY DEVICE

BACKGROUND OF THE INVENTION

1. Field of the Invention

The present invention relates to a flat panel display device and, more particularly, an active matrix type liquid crystal display device.

2. Description of the Related Art

A flat panel display device which is typified by a liquid crystal display device is employed in various fields to profitably employ characteristics of light weight, small thickness, and low power consumption. In particular, the liquid crystal display device in which a liquid crystal layer is employed as an optical modulation layer is widely employed as a display device for OA devices, home electrical appliances, etc. Especially an active matrix type liquid crystal display device in which switch elements are provided to pixels one by one is spread rapidly as the display device of the OA device.

In the liquid crystal display device, when the voltage of the video signal applied to the liquid crystal layer is unipolar, a direct current (DC) component is always applied to the liquid crystal layer. Problems such as deterioration of the liquid crystal layer are caused if such condition is continued for a long time. In order to prevent such problem, the polarity inversion driving method is executed, i.e., polarity of the voltage applied to the liquid crystal layer is inverted every frame period.

Meanwhile, a video signal is applied to the liquid crystal panel at a timing which is in synchronism with a reference clock signal being input from an external device. For this reason, if the reference clock signal is in a non-conformity state due to any reason, the DC component is applied to the liquid crystal layer over a long time. This situation causes deterioration of the liquid crystal and in turn causes abnormality in image display.

Therefore, such a technology has been proposed that a clock monitoring circuit is provided in the liquid crystal display device and thus the DC component can be prevented from being applied to the liquid crystal layer over a long time when the reference clock signal is in a non-conformity state . However, according to such configuration in the prior art, there are problems such that the number of parts to be incorporated is increased and it is difficult to use the parts in common. As a result, it is difficult to achieve improvement in productivity and a lower cost of the device.

SUMMARY OF THE INVENTION

It is an object of the present invention to provide a flat panel display device which is capable of preventing application of a DC voltage to a liquid crystal layer when a reference clock signal is in a non-conformity state and also achieving improvement in productivity and a lower cost of the device.

In order to attain the above object, according to the present invention, there is provided a flat panel display device comprising a display panel in which display pixels each of which includes a pixel electrode, an opposing electrode, and an optical modulation layer interposed between these electrodes are arranged in a matrix fashion; a first D/A converter circuit for receiving a digital video signal, a clock signal, a first voltage, and a second voltage lower than the first voltage, and then converting the digital video signal into a first analog video signal based on the clock signal; a second D/A converter circuit for receiving the digital video signal, the clock signal, the second voltage, and a third voltage lower than the second voltage, and then converting the digital video signal into a second analog video signal based on the clock signal; a driving control portion for outputting the digital video signal and the clock signal to the first D/A converter circuit and the second D/A converter circuit; and a driving circuit portion for outputting signal voltages to respective pixel electrodes in the display panel based on the first analog video signal and the second analog video signal; wherein the first D/A converter circuit and the second D/A converter circuit have a same circuit configuration which includes a clock monitoring portion for monitoring non-conformity state of the clock signal, and an output selector portion for setting both the first analog video signal and the second analog video signal to a predetermined intermediate voltage based on an output of the clock monitoring portion.

According to the above configuration, when the input clock signal is in a non-conformity state, output potentials of the first D/A converter circuit and the second D/A converter circuit are set to become substantially equal to the opposing electrode potential. Therefore, such situation that the DC voltage which is not preferable for the liquid crystal is applied for a long time can be eliminated, and thus deterioration in characteristics of the liquid crystal due to application of the DC voltage can be prevented.

Moreover, because the clock monitoring portions are built in the D/A converter circuits respectively, the number of parts can be reduced rather than the conventional liquid crystal display device in which the clock monitoring circuit is arranged independently on the outside of the display device. In addition, constituent parts of the first D/A converter circuit and the second D/A converter circuit can be employed commonly. Accordingly, improvement in productivity and a lower cost of the device can be achieved.

BRIEF DESCRIPTION OF THE DRAWINGS

FIG. 7 is a view showing data arrays of video signals which are rearranged by a control IC;

DETAILED DESCRIPTION OF THE PREFERRED EMBODIMENTS

An embodiment of the case where a flat panel display device according to the present invention is applied to a liquid crystal display device for a personal computer will be explained hereinafter. The liquid crystal display device to be explained in this embodiment includes an active matrix type liquid crystal panel. A driving circuit using p-Si type TFTs is integrated in this liquid crystal panel.

Figure 1:
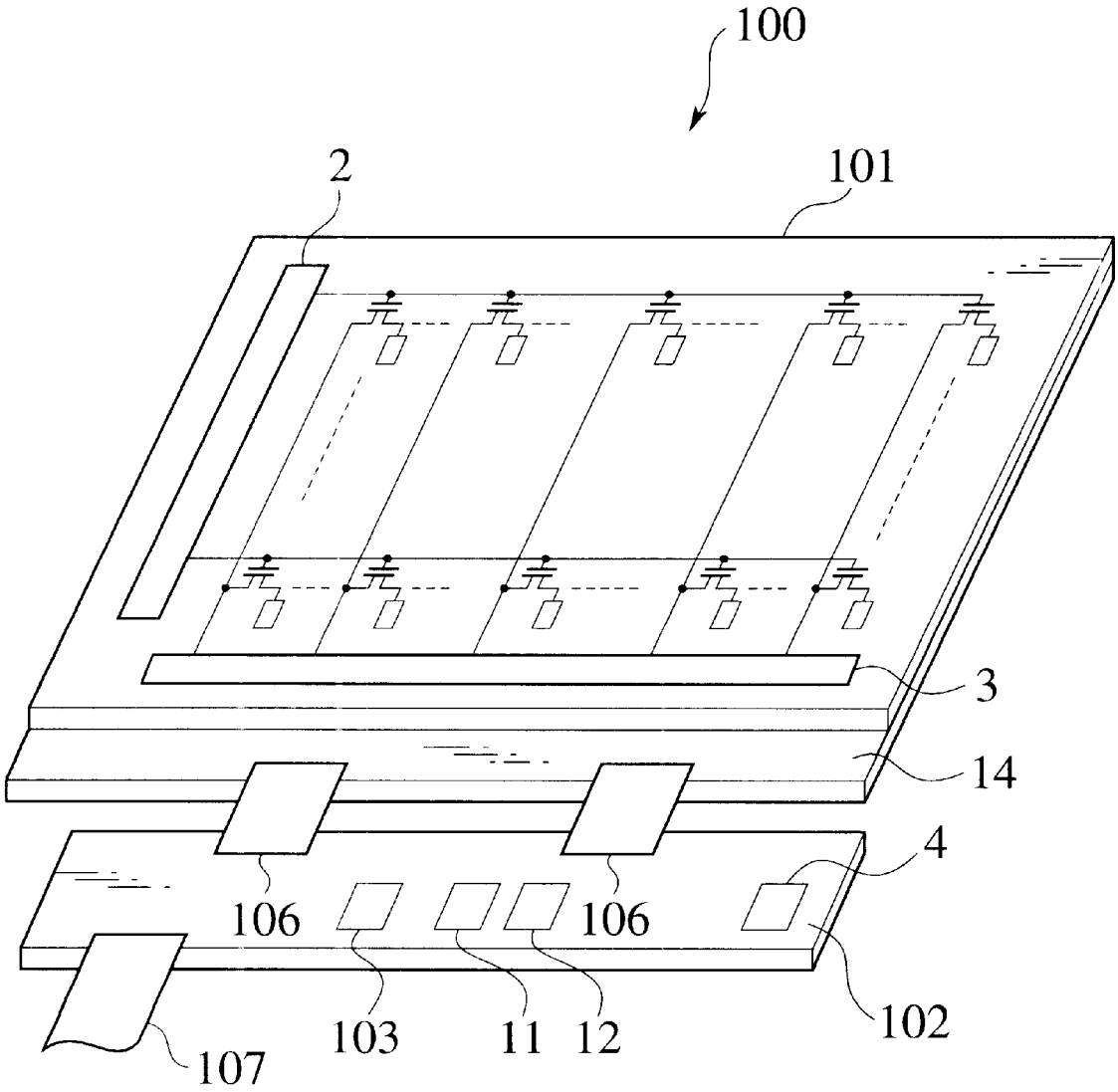
FIG. 1 is a block diagram showing an overall configuration of a liquid crystal display device according to an embodiment of the present invention.

FIG. 1 is a block diagram showing an overall configuration of a liquid crystal display device according to embodiments of the present invention. A liquid crystal display device 100, if roughly classified, comprises a liquid crystal panel 101 in which a driving circuit is integrated, a driving circuit board 102 which supplies an analog video signal to the liquid crystal panel 101, and flexible print circuit boards (FPCs) 106 which connect electrically the liquid crystal panel 101 and the driving circuit board 102.

Figure 2:
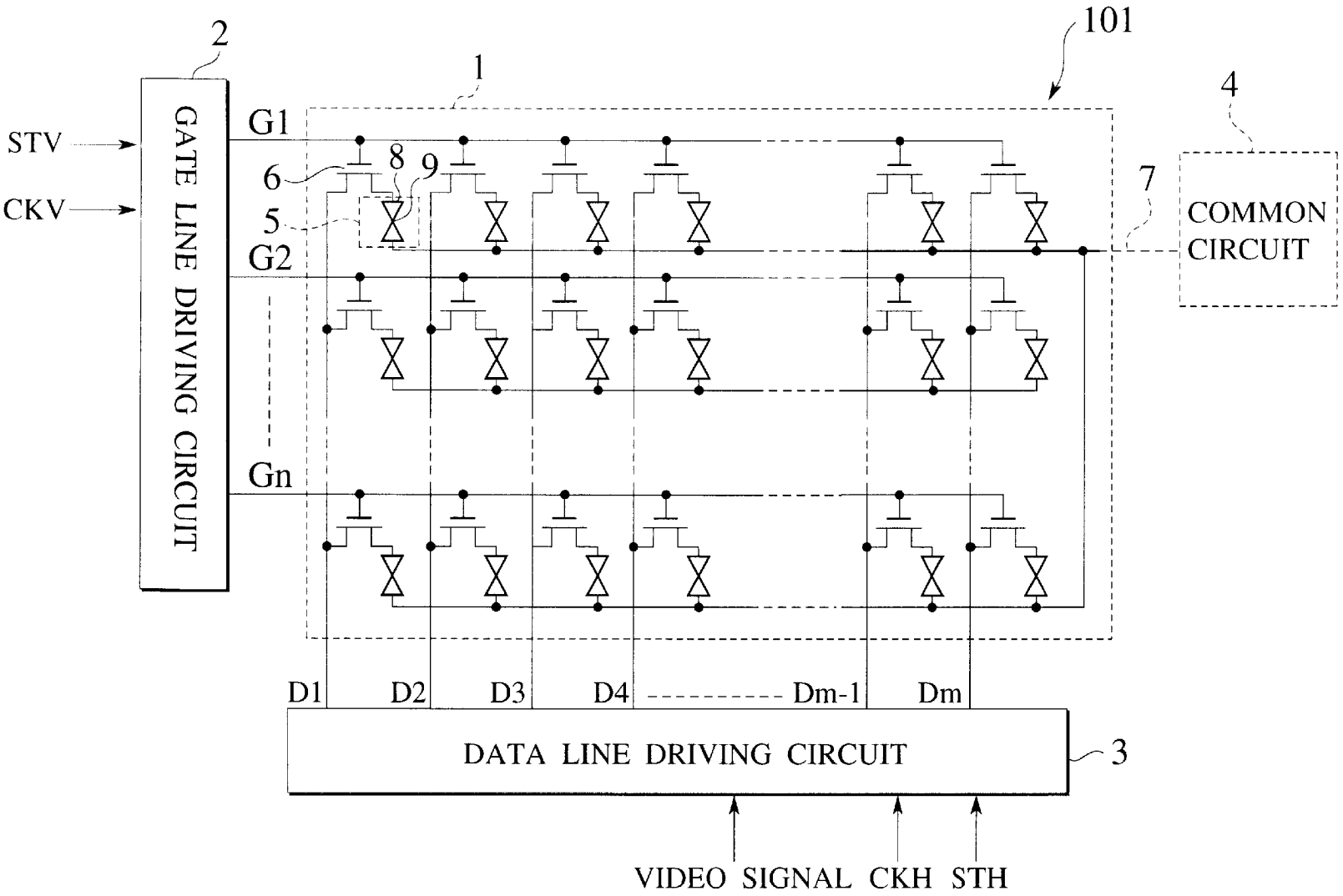
FIG. 2 is a view showing a circuit configuration of a liquid crystal panel.

FIG. 2 is a view showing a circuit configuration of the liquid crystal panel 101. The liquid crystal panel 101 comprises an active matrix portion 1, a gate line driving circuit 2 , and a data line driving circuit 3. The gate line driving circuit 2 and the data line driving circuit 3 are integrated on one insulative circuit board 14 of the liquid crystal panel 101. A common circuit (opposing electrode driving circuit) 4 is placed on the driving circuit board 102, as shown in FIG. 1. Nevertheless, in order to facilitate the explanation, such common circuit 4 is shown in FIG. 2.

The active matrix portion 1 is constructed by arranging a plurality of liquid crystal pixels (display pixels) 5 in a matrix fashion. Each of the liquid crystal pixels 5 is composed of a pixel electrode 8, an opposing electrode 7, and a liquid crystal layer (optical modulation layer) 9 held between these electrodes. Supply of a video signal to each pixel electrode 8 is controlled by a TFT 6 serving as a switching device.

Gates of the TFTs 6 are connected to gate lines G1, G2, . . . , Gn row by row. Drains of the TFTs 6 are connected to data lines D1, D2, . . . , Dm column by column. Each source of the TFT 6 is connected to the pixel electrode 8. The opposing electrode 7 which correspond to all liquid crystal pixels 5 is connected to the common circuit 4.

The gate line driving circuit 2 is composed of a circuit which includes shift registers and buffers (not shown). The gate line driving circuit 2 supplies address signals to gate lines G1, G2, . . . , Gn according to a vertical synchronizing signal STV and a vertical clock signal CKV.

The data line driving circuit 3 is composed of a circuit which includes a sample hold circuit (not shown) for sampling analog video signals, which are supplied from the driving circuit board 102, to data lines D1, D2, . . . , Dm, and a shift register (not shown) for controlling sampling timings of the sample hold circuit. A horizontal start signal STH, a horizontal clock signal CKH, and analog video signals are supplied to the data line driving circuit 3.

The driving circuit board 102 shown in FIG. 1 is a driving circuit portion which outputs voltages to be applied to the pixel electrodes 8 of the liquid crystal panel 101 as analog video signals of positive polarity and analog video signals of negative polarity with respect to a reference voltage. The driving circuit board 102 comprises a control IC 103, a positive polarity D/A converter (first D/A converter circuit) 11, a negative polarity D/A converter (second D/A converter circuit) 12, and the common circuit 4. And, the driving circuit board 102 and a processor of the personal computer (not shown) is connected by a FPC 107.

Figure 3:
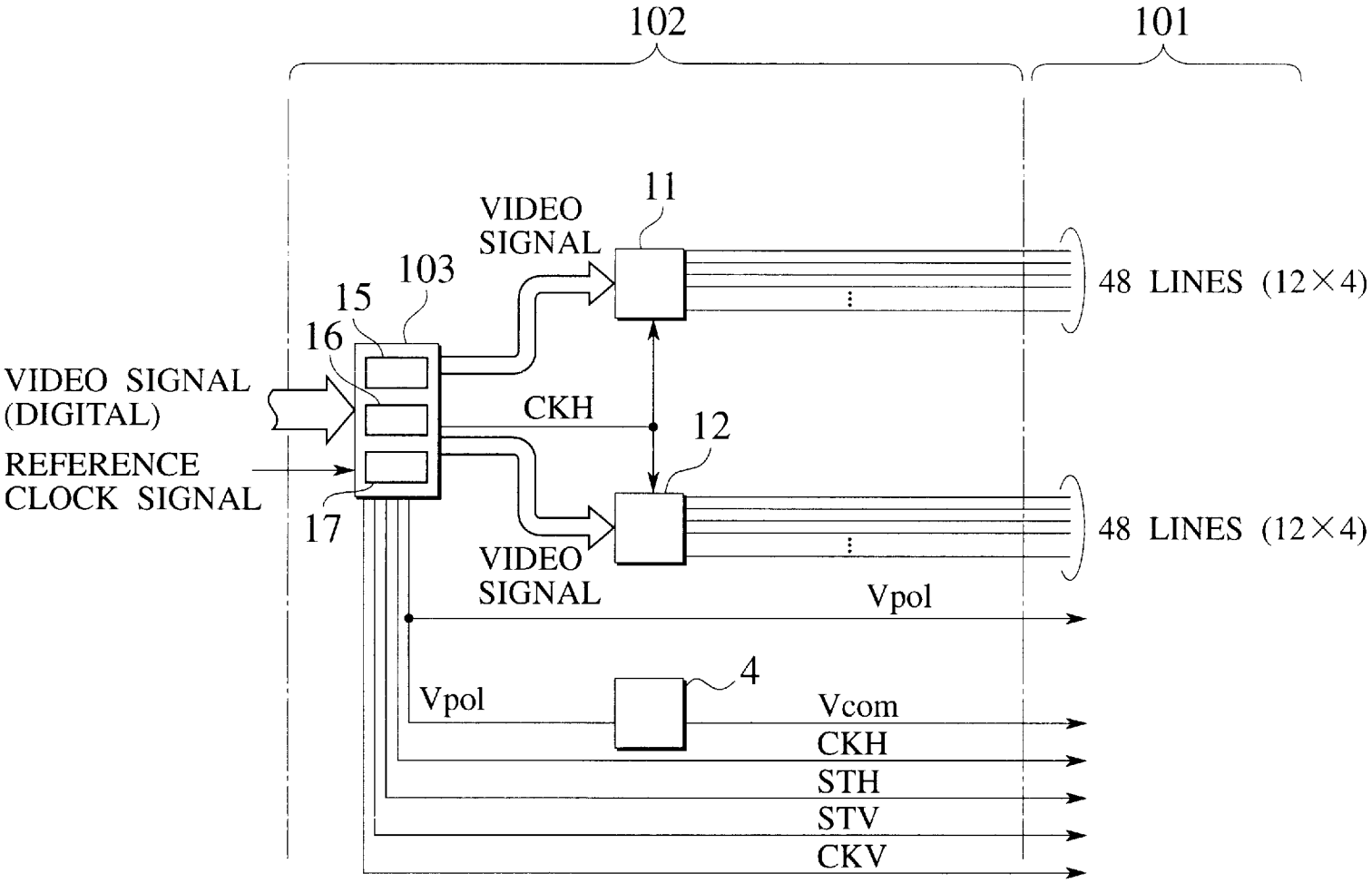
FIG. 3 is a view showing a circuit configuration of a driving circuit board.

FIG. 3 is a view showing a circuit configuration of the driving circuit board 102. Digital video signals and a reference clock signal are supplied from the processor of the personal computer (not shown) to the control IC 103. As the digital video signals, data of 1024 pixels in each horizontal scaning periods are supplied for respective R, G, B colors and thus data of 3072 pixels are supplied sequentially for one scanning line.

The control IC 103 includes a rearranging circuit 15 containing 2-line memory for storeing and rearranging the digital video signals being supplied from the processor to prepare the polarity inversion driving described later, and a selection outputting circuit 16 for allocating the digital video signals to the positive polarity D/A converter 11 or the negative polarity D/A converter 12 based on to the polarity of each digital video signal every frame and then outputting them. Similarly, the control IC 103 includes a control signal generating portion 17 for generating and outputting various clock signals such as a horizontal clock signal CKH, a polarity inversion signal (Vpol), etc. based on the reference clock signal fetched from the same processor.

The positive polarity D/A converter 11 and the negative polarity D/A converter 12 convert the digital video signals supplied from the control IC 103 into analog video signals, and then supplies them to the liquid crystal panel 101. In the liquid crystal panel 101 according to this embodiment, a display screen is split into four areas along the data lines and then twenty-four video signals are supplied to each area.

Twelve positive polarity video signals and twelve negative polarity video signals are supplied to one area.

Twelve positive polarity video signals are output to four areas respectively, i.e., 48 video signals are output in total, from the positive polarity D/A converter 11. Twelve negative polarity video signals are output to four areas respectively, i.e., 48 video signals are output in total, from the negative polarity D/A converter 12.

Forty-eight positive polarity D/A converter portions (not shown) are placed in the positive polarity D/A converter 11 shown in FIG. 3, while forty-eight negative polarity D/A converter portions (not shown) are placed in the negative polarity D/A converter 12. Respective configurations of the positive polarity D/A converter 11 and the negative polarity D/A converter 12 will be explained in detail later.

Then, polarity inversion driving of the liquid crystal panel in the foregoing active matrix type liquid crystal display device will be explained.

In the normal liquid crystal display device, the polarity of the voltage between the pixel and opposing electrodes of the liquid crystal panel every frame is inverted in order to prevent deterioration in characteristics of the liquid crystal layer 9. As such polarity inversion driving method, for example, there have been known the V (vertical) line inversion driving method which inverts the polarity of the voltage between the pixel and the opposing electrodes every neighboring vertical pixel line (every column), the H/V (vertical/horizontal) lines inversion driving method which inverts the polarity of potential difference applied between pixel and the opposing electrodes every neighboring pixel, etc.

In the meanwhile, normally the voltage of about ±5 V is needed in order to drive the liquid crystal. Accordingly, the breakdown voltage of 10 V is needed as the output of the driving circuit in order to implement the above inversion driving method and thus it has been difficult to reduce power consumption. Therefore, the liquid crystal display device has been proposed for the purpose of reducing the power consumption.

For example, in Japanese Patent Application Laid-Open Publication (KOKAI) Hei 9-186151, a following display device is disclosed. This display device comprises a plurality of D/A converter circuits for converting serial video signal being input from an external device into analog signals by virtue of serial-parallel conversion, and amplifiers connected to respective D/A converter circuits. The amplifiers which are connected to neighboring D/A converter circuits are connected to power supply voltages of opposite polarity mutually. A pair of switch pair are connected to respective amplifiers, and switches which constitute the switch pair are connected to a data signal line respectively.

According to this configuration, since the driving circuit can be operated under the breakdown voltage of single polarity, the power consumption can be reduced. In addition, since a video signal bus can be used in common between neighboring signal lines, the number of the video signal bus can be reduced and thus a circuit scale can be reduced.

In the display device disclosed in this Japanese Patent Application Laid-Open Publication (KOKAI) Hei 9-186151, in a certain frame period, the odd-numbered D/A converter circuits drive odd-numbered data lines while even-numbered D/A converter circuits drive even-numbered data lines. In a succeeding frame period, the odd-numbered D/A converter circuits drive the even-numbered data lines while even-numbered D/A converter circuits drive the odd-numbered data lines. In order to enable such polarity inversion driving, rearrangement of the digital video signals is performed synchronized with the frame periode by using memories which are externally arranged previously.

Next, a method of driving the liquid crystal panel 101 according to the embodiment of the present invention will be explained hereunder.

Figure 4:
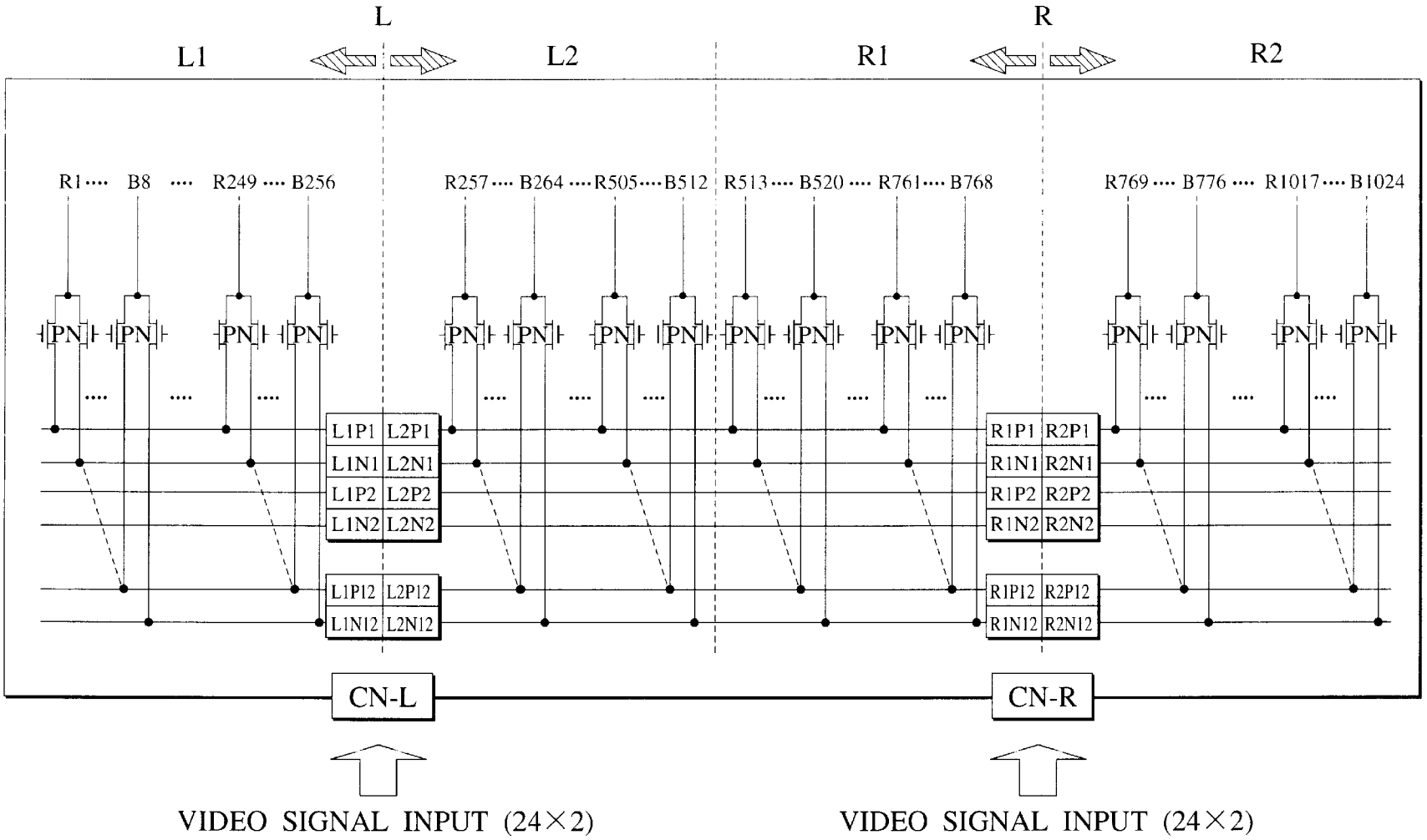
FIG. 4 is a wiring diagram showing a method of driving a liquid crystal panel according to the embodiment of the present invention.

FIG. 4 is a wiring diagram showing the method of driving the liquid crystal panel 101 according to the embodiment, and shows mainly a relationship between the data lines and analog video buses electrically connected to the data lines.

In FIG. 4, L1, L2, R1, R2 indicate display areas of the display screen which is four-split along the data lines respectively. While setting right and left lines (line L, line R) of three lines which partition the display screen into four areas as respective centers, the video signals supplied to respective areas are scanned all at once along directions indicated by arrows respectively. This is because discontinuity of the images at boundary portions between the split areas must be eliminated. For such scanning, the data line driving circuit 3 is split into four internal portions. More particularly, circuit groups constituting the data line driving circuit 3 such as shift registers, sample hold circuits, etc. are constructed such that they can be operated in respective areas independently. In case the video signals are sampled simultaneously in four areas and then output like this example, a sampling time can be extended four times as long as the case where video signal for each horizontal scaning periods is sampled sequentially.

The analog video signals are supplied from the driving circuit board 102 in FIG. 1 to input terminals CN-L, CN-R in FIG. 4. Twenty-four video signals to be supplied to respective areas are input into the input terminals CN-L, CN-R More particularly, forty-eight (24×2) video signals to be supplied to the areas L1, L2 respectively are input into the input terminal CN-L, while forty-eight (24×2) video signals to be supplied to the areas R1, R2 respectively are input into the input terminal CN-R. After input into the liquid crystal panel 101, the video signals are output to a switch circuit (113), which is described later, via 24 analog video bus lines (e.g., L1P1, L1N1, . . . , L1P12, L1N12) wired in each area. As, to which voltage being output as the positive polarity video signals are supplied and lines to which data being output as the negative polarity video signals are supplied are aligned alternatively. In the analog video bus lines shown in FIG. 4, the positive polarity lines are labeled as "P" and the negative polarity lines are labeled as "N". For example, the analog video bus line L1P1 denotes the positive polarity line, while the analog video bus line L1N1 denotes the negative polarity line.

Figure 5:
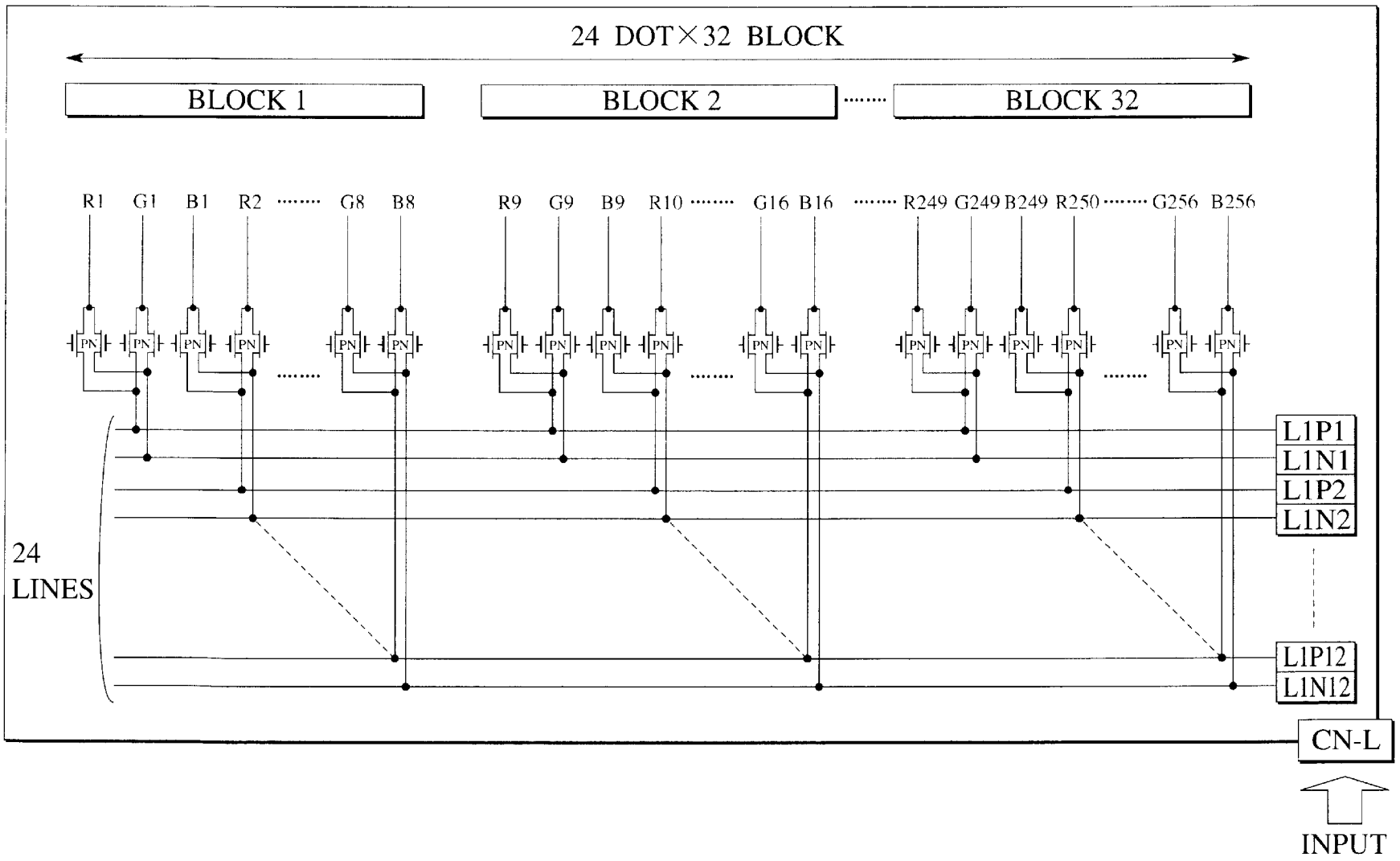
FIG. 5 is an partially enlarged view showing an area L1 shown in FIG. 4.

FIG. 5 is an partially enlarged view showing an area L1 shown in FIG. 4. Further, one area is split internally into 32 blocks. Then, eight lines are assigned to respective colors of R, G, B every block. For instance, R1, . . . , R8, G1, . . . , G8, B1, . . . , B8 are assigned to a block 1, R9, . . . , R16, G9, . . . , G16, B9, . . . , B16 are assigned to a block 2. Similarly, R249, . . . R256, G249, . . . , G256, B249, . . . , B256 are assigned to a block 32. In this manner, eight lines are assigned to respective colors of R, G, B in each block, so that 24-line video signals are sampled simultaneously in total in one block. In addition, as shown in FIG. 5, the video signals can be sampled in each area by sampling the 32 blocks in sequence in unit of one block and then output. For example, if the sampling is executed in the order of the block 32 to the block 1 in the area L1, the video signals are sampled sequentially from B256 to R1 in the area L1 in FIG. 4 and then output. The similar sampling is performed on other areas. Like wise, since 24×32 pixels, i.e., 768 pixels can be sampled in one area, the sampling corresponding to 3072 pixels per one scanning line can be achieved in total in four areas. The video signals for one frame are loaded sequentially into the pixels by repeating such sampling output by the number of scanning lines.

In the liquid crystal panel 101 according to this embodiment, the V line inversion driving method is employed. That is to say, the data line driving circuit 3 drives the data lines in respective frame periods such that potentials of neighboring data lines have the opposite polarity mutually and the potentials of respective data lines is polarity-inverted every frame period.

Figure 6:
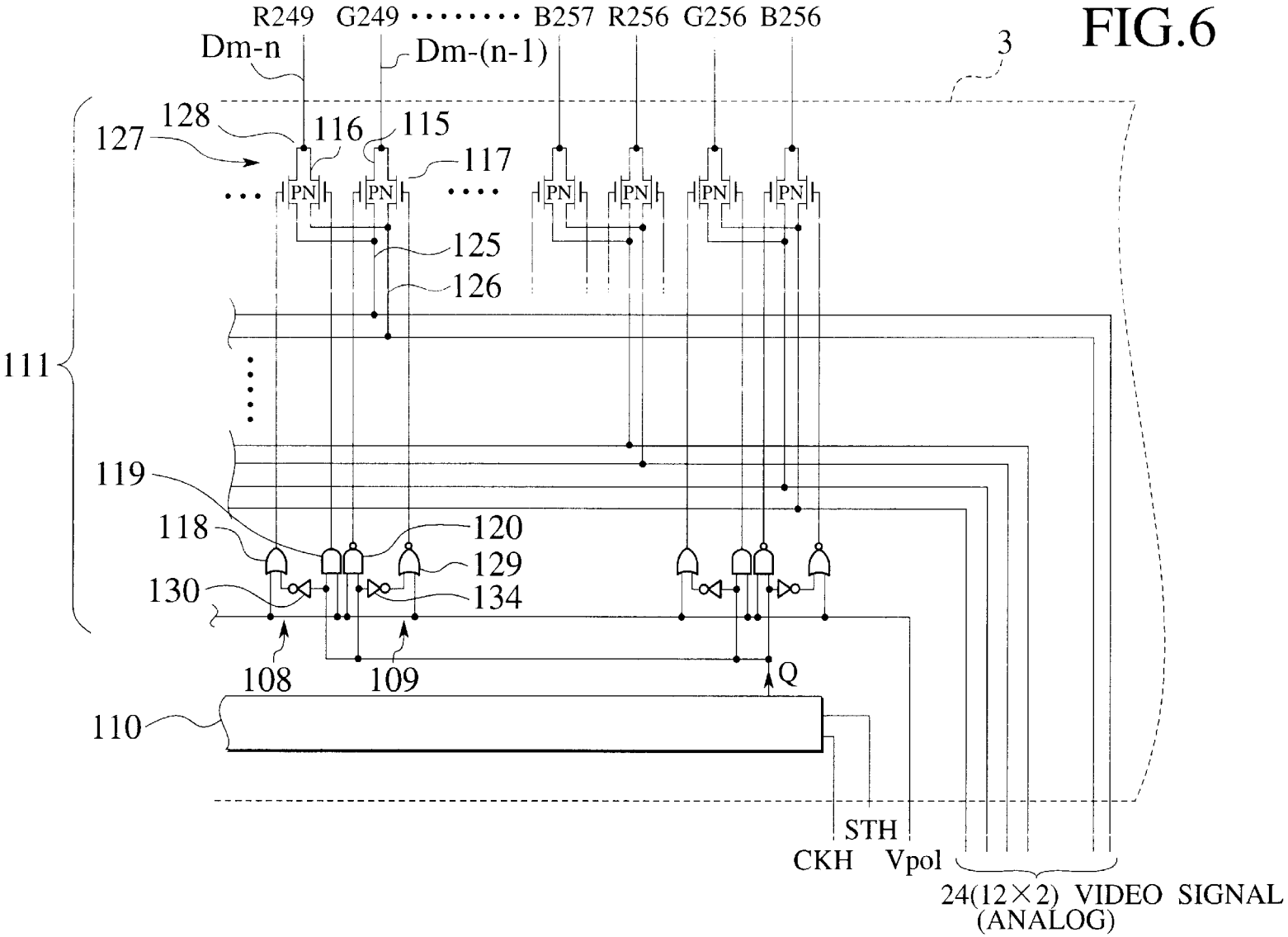
FIG. 6 is a fragmentary circuit diagram showing a data line driving circuit.

FIG. 6 is a fragmentary circuit diagram showing the data line driving circuit 3. FIG. 6 shows a circuit configuration of a data line driving circuit portion corresponding to the area LI in the data line driving circuit 3 which is four-split internally.

The data line driving circuit 3 comprises a shift register 110, and a sample hold circuit 111. The data line driving circuit 3 is constructed to execute serial-parallel conversion of the analog video signals being supplied from the driving circuit board 102 (FIG. 4) in synchronism with the horizontal clock signal CKH and then output them to respective data lines.

An output Q of the shift register 110 is input into an odd-number ed signal switching circuit 108 and an even-numbered signal switching circuit 109. The odd-numbered signal switching circuit 108 is connected to a positive polarity analog video bus line 125, and the even-numbered signal switching circuit 109 is connected to a negative polarity analog video bus line 126. The R, G, B analog signals of positive polarity are input into the positive polarity analog video bus line 125, and the R, G, B analog signals of negative polarity are input into the negative polarity analog video bus line 126.

Each of the switch circuits 127 consists of a pair of plural Pchtransistors and plural Nch-transistors. The positive polarity analog video bus line 125 is connected to data lines Dm-n, Dm-(n-1) via the Pch-transistors 128, 115. The negative polarity analog video bus line 126 is connected to data lines Dm-n, Dm-(n-1) via the Nch-transistors 116, 117.

A gate of the Pch-transistor 128 is connected to an output terminal of an OR gate 118, and a gate of the Nch-transistor 116 is connected to an output terminal of an AND gate 119. Also, a gate of the Pch-transistor 115 is connected to an output terminal of a NAND gate 120, and a gate of the Nch-transistor 117 is connected to an output terminal of a NOR gate 129.

A polarity inversion signal Vpol is input into the OR gate 118, the AND gate 119, the NAND gate 120, and the NOR gate 129. The AND gate 119 and the NAND gate 120 are connected to an output Q of the shift register 110. The output Q of the shift register 110 is connected to the OR gate 118 via an inverter 130, and the output Q of the shift register 110 is also connected to the NOR gate 129 via an inverter 134. The shift register 110 is constructed to shift the horizontal start signal STH sequentially in synchronism with the horizontal clock signal CKH. The output Q of the shift register 110 is output based on the horizontal start signal STH.

Next, an operation of the circuit shown in FIG. 6 will be explained hereunder. Operations of a pair of neighboring data lines Dm-n and Dm -(n-1), and the switch circuit 113 and the signal switching circuits 108, 109 being connected to these lines will be explained hereunder. Assume that the polarity inversion signal Vpol which is supplied to the signal switching circuits 108, 109 indicates the positive polarity at its "Low" level and the negative polarity at its "High" level respectively, and that the polarity inversion signal Vpol can be switched frame after frame.

If the polarity inversion signal Vpol is set at the "Low" level, the OR gate 118 is brought into a state to pass through the output Q of the shift register 110, and thus an output of the AND gate 119 becomes the "Low" level. Then, an output of the NAND gate 120 becomes the "High" level, and the NOR gate 129 is brought into a state to invert the output Q and then pass it therethrough. Accordingly, the Pch-transistor 128 is brought into its conductive state by the output Q of the shift register 110, and the Nch-transistor 116 and the Pch-transistor 115 are brought into their nonconductive state. The Nch-transistor 117 is brought into its conductive state by the output Q of the shift register 110. As a result, the positive polarity video signals are output to the data line Dm-n based on the output Q of the shift register 110. In contrast, the negative polarity video signals are output to the data line Dm-(n-1) based on the output Q of the shift register 110.

In case the polarity inversion signal Vpol is at the "High" level, an output of the OR gate 118 becomes the "High" level, and the AND gate 119 is brought into its state to pass through the output Q of the shift register 111. The NAND gate 120 is brought into its state to pass through the inverted output Q, and an output of the NOR gate 129 is at its "Low" level. Therefore, the Pch-transistor 114 is brought into its nonconductive state, and the Nch-transistor 116 is brought into its conductive state by the output Q of the shift register 110. Also, the Pch-transistor 115 is brought into its conductive state by the output Q of the shift register 110, and the Nch-transistor 117 is brought into its non-conductive state. As a result, the negative polarity video signals are output to the data line Dm-n based on the output Q of the shift register 110. Meanwhile, the positive polarity video signals are output to the data line Dm-(n-1) based on the output Q of the shift register 110.

The positive polarity video signals and the negative polarity video signals are output alternatively to the neighboring data lines Dm-n, Dm-(n-1) by repeating the above operations every frame. As for other data lines, similarly the positive polarity video signals and the negative polarity video signals are output alternatively to the neighboring data lines. In the above circuit configuration, only the positive polarity video signals are output to the analog video bus line 125, and only the negative polarity video signals are output to the analog video bus line 126. As a result, since respective gate elements of the sample hold ciruit 112 can be operated by the breakdown voltage of a single polarity, the power consumption can be reduced.

FIG. 7 is a view showing data arrays of the video signals which are rearranged by the control IC 103 (FIG. 3). Right side portions in FIG. 7 indicate data arrays in the case where the video signals for one line being supplied from the processor are rearranged for the blocks 1 to 32 in the areas L1, L2, R1, R2. Left side portions in FIG. 7 indicate polarities (Pol) of the polarity inversion signal and an assignment rule of the signals to the analog video bus lines at that time. Pol=0 ("Low" level) indicates the assignment conducted when the polarity inversion signal is at the time of positive polarity, while Pol=1 ("High" level) indicates the assignment conducted when the polarity inversion signal is at the time of negative polarity.

Data assignment will be explained while taking the block 1 of the area L1 as an example.

In case the polarity inversion signal is Pol=0, the video signal "R249" is supplied to the analog video bus line L1P1 in the block 1, and the video signal "G249" is supplied to the analog video bus line L1N1 of the same. The video signal "R249" is output from the data line Dm-n via the Pch-transistor 114 in FIG. 6, and the video signal "G249" is output from the data line Dm-(n-1) via the Nch-transistor 117 in FIG. 6. In contrast, in case the polarity inversion signal is Pol=l, the video signa1 "G249" is supplied to the analog video bus line L1P1 in the block 1, and the video signal "R249" is supplied to the analog video bus line L1N1 of the same. The video signal "G249" is output from the data line Dm(n-1) via the Pch-transistor 115 in FIG. 6, and the video signal "R249" is output from the data line Dm-n via the Nch-transistor 116 in FIG. 6.

According to the rearrangement of data shown in FIG. 7, only the positive polarity video signals are always output to the analog video busline 125 in FIG. 6, while only the negative polarity video signals are always output to the analog video bus line 126. In other words, the polarity of the video signal is inverted between the neighboring data lines Dm-n, Dm-(n-1) every frame, but the video signals of the same polarity are always output to respective analog video bus lines.

The example employing the V line inversion driving method has been explained in the above embodiment, but the so-called H/V lines inversion driving method in which the polarity of the video signals being supplied to the data line is inverted every row may be employed.

Then, circuit configurations of the positive polarity D/A converter 11, the negative polarity D/A converter 12, and the common circuit 4 shown in FIG. 3 will be explained as an embodiment 1 and an embodiment 2 hereunder. Assume that embodiments to be described in the following are so constructed that the V line inversion driving is applied to the liquid crystal panel 101 and also positive/negative potentials can be derived from outputs of individual D/A converter ICs.

Embodiment 1

Figure 8:
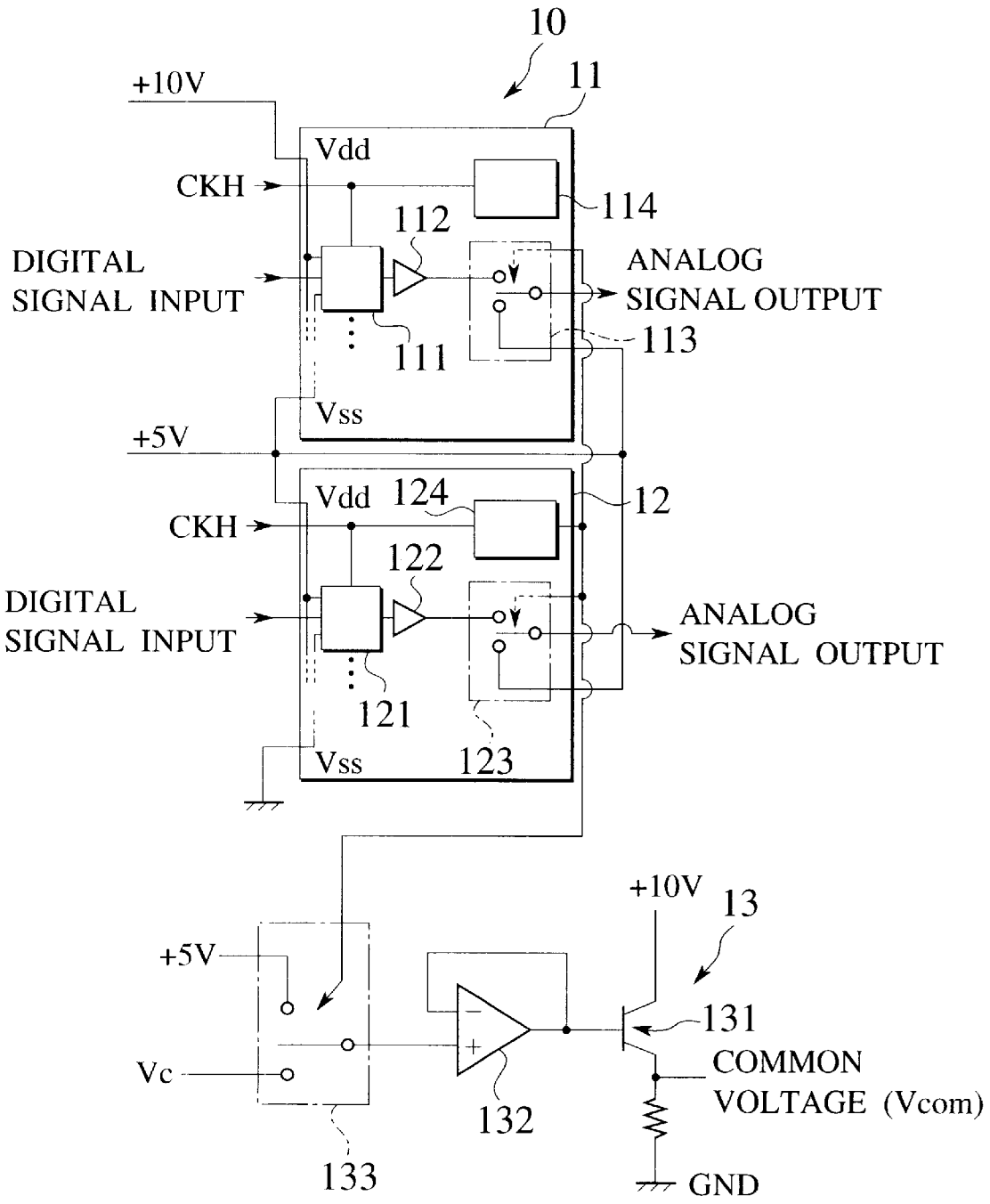
FIG. 8 is a block diagram showing circuit configurations of a D/A converter and a common circuit according to an embodiment 1 of the present invention.

FIG. 8 is a block diagram showing circuit configurations of a D/A converter 10 and a common circuit 13 according to an embodiment 1 of the present invention.

The D/A converter 10 consists of a positive polarity D/A converter 11, and a negative polarity D/A converter 12. Both the positive polarity D/A converter 11 and the negative polarity D/A converter 12 are formed of an IC chip having the same configuration and the same breakdown voltage.

The positive polarity D/A converter 11 executes D/A conversion of digital video signals (digital signal input) which are input from the control IC 103 (FIG. 3), and then outputs them to the LCD panel as analog signals of the positive polarity relative to the reference voltage. Similarly, the negative polarity D/A converter 12 executes D/A conversion of the digital video signals, and then outputs them to the LCD panel as analog signals of the negative polarity relative to the reference voltage.

The positive polarity D/A converter 11 is composed of a D/A converter portion 111, an output buffer 112, a switch circuit 113 corresponding to an output selector portion, and a clock monitoring circuit 114 corresponding to a clock monitoring portion. A power supply potential (Vdd) of +10 V corresponding to a first voltage and a ground potential (Vss) of +5 V corresponding to a second voltage are input externally.

The negative polarity D/A converter 12 is composed of a D/A converter portion 121, an output buffer 122, a switch circuit 123, and a clock monitoring circuit 124. A Power Supply potential (Vdd) of +5 V corresponding to the second voltage and a ground potential (Vss) of 0 V (GND) corresponding to a third voltage are input from the external side.

When the digital video signals and the horizontal clock signal CKH are input from the control IC 103 (FIG. 3) to the positive polarity D/A converter 11 and the negative polarity D/A converter 12, the D/A converter portions 111, 121 of respective D/A converters 11, 12 sample—hold the video signals in synchronism with the horizontal clock signal CKH, then convert them into the analog signals, and then output them to the output buffers 112, 122. After this, the analog signals are output from the output buffers 112, 122 to the liquid crystal panel via the switch circuits 113, 123.

In FIG. 8, in order to simplify the explanation, the D/A converter portion, the output buffer, and the switch circuit are shown in single respectively in the positive polarity D/A converter 11 and the negative polarity D/A converter 12. But the D/A converter portion, the output buffer, and the switch circuit are provided respectively as many as the number (twenty-four in this embodiment) according to the outputs of the video signals. This is true of an embodiment 2 described later.

The clock monitoring circuits 114, 124 monitor whether the horizontal clock signal CKH which is generated based on the reference clock signal is being regularly input or non-conformity state. If the reference clock signal is in a non-conformity state due to any reason, for instance, the horizontal clock signal CKH is not conformity input. According to states of the horizontal clock signal CKH, the clock monitoring circuits 114, 124 output different control signals to the switch circuits 113, 123, and 133. The clock monitoring circuits 114, 124 are placed one by one in the positive polarity D/A converter 11 and the negative polarity D/A converter 12 respectively.

Since the same horizontal clock signal CKH is input into both the positive polarity D/A converter 11 and the negative polarity D/A converter 12, the horizontal clock signal CKH may be monitored by any one of the clock monitoring circuits 114, 124. In the D/A converter 10 shown in FIG. 8, the circuit is so constructed that the horizontal clock signal CKH can be monitored by the negative polarity D/A converter 12.

The switch circuits 113, 123 are switch circuits which select one of the voltage of +5 V being input from the external device and the analog signal outputs being output from the output buffer 112, 122 and then output them respectively. Input selection in the switch circuits 113, 123 is controlled by a control signal being output from the clock monitoring circuit 124 in the negative polarity D/A converter 12. During when the horizontal clock signal CKH is being regularly input into the D/A converter 10, the analog signal output is selected as an input in the switch circuits 113, 123 respectively according to the control signal being output from the clock monitoring circuit 124. In contrast, when the horizontal clock signal CKH is in a non-conformity state, for instance, the voltage of +5 V which is the external input is selected as an input according to the control signal being output from the clock monitoring circuit 124.

The common circuit 13 which is connected to the opposing electrode side is composed of a current amplifier portion 131 consisting of the Pch-transistor and a resistor, an operational amplifier 132 for supplying a predetermined voltage to the current amplifier portion 131, and a switch circuit 133 connected to the input side of the operational amplifier 132. The current amplifier portion 131 of the common circuit 13 is connected to +10 V and ground (GND). The switch circuit 133 selects one of two inputs, i.e., the DC common control voltage (Vc) which is divided by resistance between +10 V and 0 V and the voltage of +5 V which is the same as one of respective input voltages of the positive polarity D/A converter 11 and the negative polarity D/A converter 12, and then outputs it. Input selection in the switch circuit 133 is controlled by a control signal being output from the clock monitoring circuit 124 in the negative polarity D/A converter 12.

During when the horizontal clock signal CKH is being regularly input into the D/A converter 10, the common control voltage (Vc) is selected as an input in the switch circuit 133 according to the control signal from the clock monitoring circuit 124. Based on this situation, a DC common voltage (Vcom) of +4.5 V is output.

On the contrary, when the horizontal clock signal CKH supplied to the D/A converter 10 is in a non-conformity state, the voltage of +5 V as the external input is selected as an input in the switch circuit 133 according to the control signal from the clock monitoring circuit 124, and then a DC common voltage (Vcom) of +5 V is output.

Subsequently, an operation of the D/A converter 10 constructed as above will be explained hereunder.

The clock monitoring circuit 124 of the negative polarity D/A converter 12 monitors the states of the horizontal clock signal CKH. During when the horizontal clock signal CKH is being regularly input, the clock monitoring circuit 124 outputs the control signal such that the analog signal output is selected as inputs of the switch circuits 113 and 123. At the same time, the common control voltage (Vc) is selected as an input according to this control signal in the switch circuit 133 of the common circuit 13.

Meanwhile, when inputting of the horizontal clock signal CKH is in a non-conformity state, the clock monitoring circuit 124 outputs the control signal to select the voltage of +5 V, which is the external input, as the inputs of the switch circuits 113 and 123. As a result, both outputs of the positive polarity D/A converter 11 and the negative polarity D/A converter 12 become +5 V together. At the same time, the voltage of +5 V which is the external input is selected as an input by this control signal in the switch circuit 133 of the common circuit 13. As a consequence, an output (Vcom) of the common circuit 13 becomes +5 V like the outputs of two D/A converters 11, 12.

According to the above driving circuit, since both the output voltage of the D/A converter and the common voltage can be set to the same voltage (+5 V) when the horizontal clock signal CKH is in a non-conformity state, the DC voltage can be prevented from being applied to the liquid crystal.

Figure 9A:
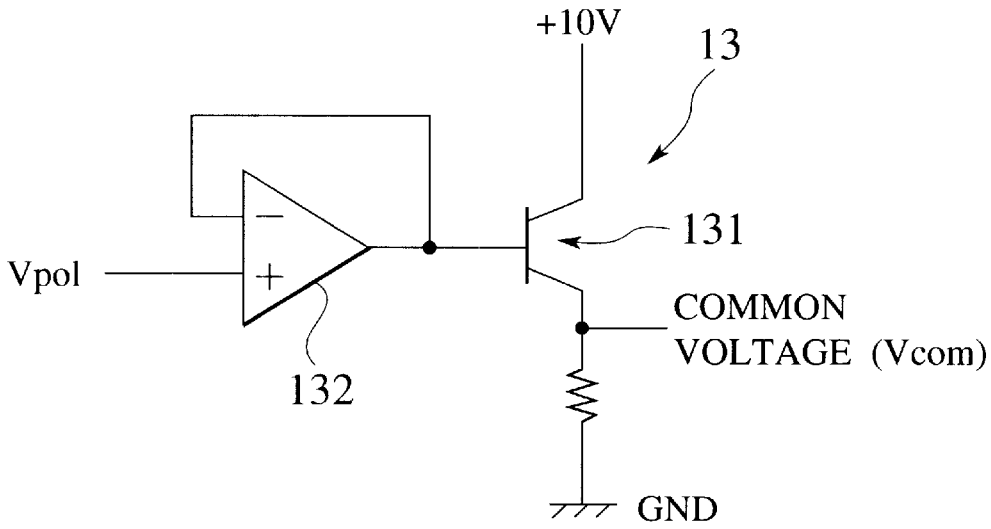
FIGS. 9A and 9B are circuit diagrams showing other circuit configuration of the common circuit respectively.

In the D/A converter 10 according to this embodiment 1, a circuit configuration is so constructed that, when the horizontal clock signal CKH is in a non-conformity state, the output of the common circuit 13 can be set to +5 V, which is the same potential as the outputs of two D/A converters, according to the control signal of the clock monitoring circuit 124. As another embodiment, a configuration in which the switch circuit 132 is omitted, as shown in FIG. 9, for example, may be adopted. In this case, the DC common voltage (Vcom) of +4.5 V, for example, is always output regardless of the states of the horizontal clock signal CKH. As a result, the DC component is applied slightly to the liquid crystal layer, nevertheless the circuit configuration can be simplified and thus the lower cost of the device can be attained.

Embodiment 2

Figure 10:
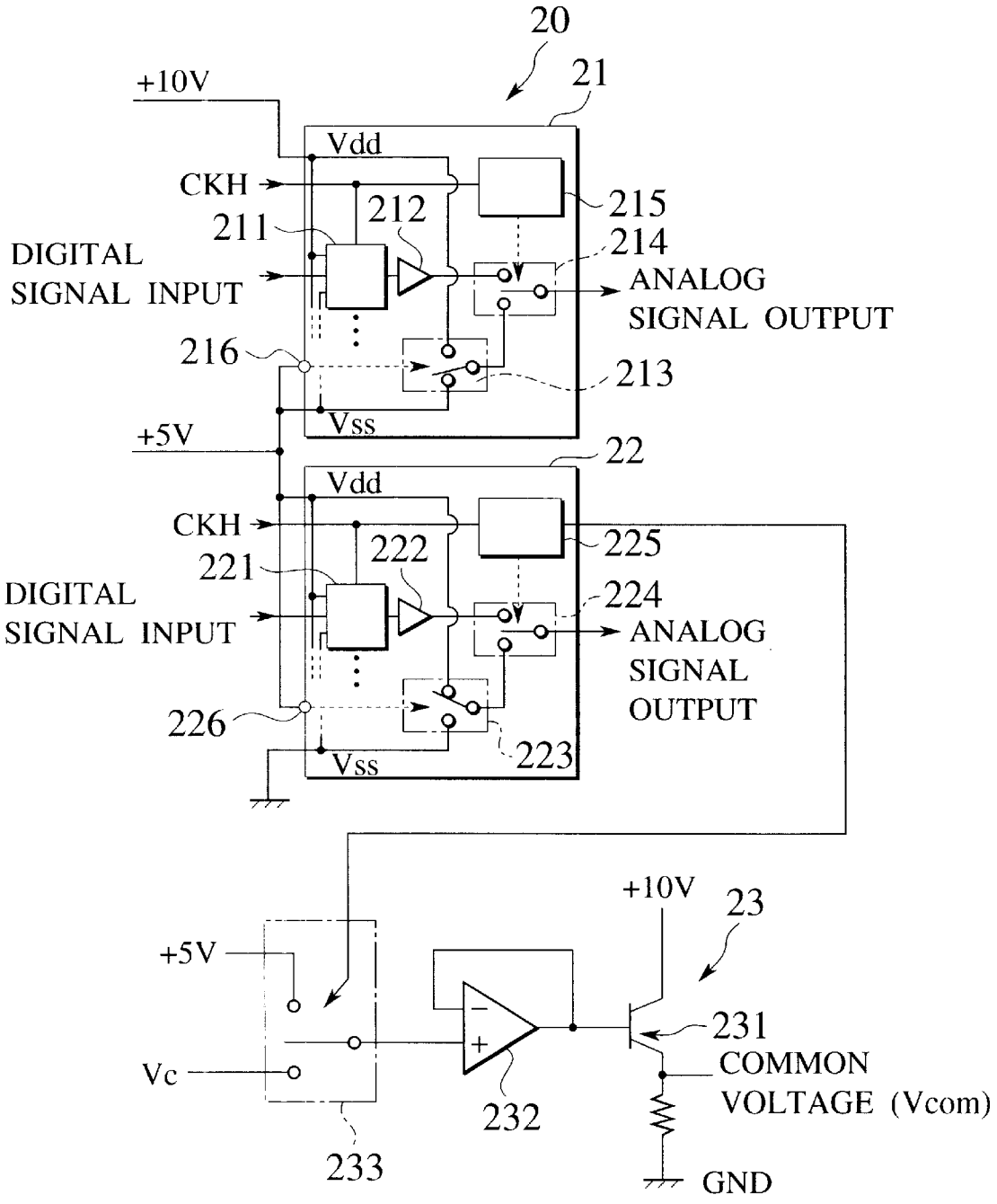
FIG. 10 is a block diagram showing circuit configurations of a D/A converter and a common circuit according to an embodiment 2 of the present invention.

FIG. 10 is a block diagram showing circuit configurations of a D/A converter 20 and a common circuit 23 according to an embodiment 2 of the present invention.

The D/A converter 20 comprises a positive polarity D/A converter 21, and a negative polarity D/A converter 22. Both the positive polarity D/A converter 21 and the negative polarity D/A converter 22 are formed of an IC chip having the same configuration and the same breakdown voltage.

The positive polarity D/A converter 21 executes the D/A conversion of digital video signals (digital signal input) which are input from the control IC 103 (FIG. 3), and then outputs them to the analog video buses as analog signals of the positive polarity relative to the reference voltage. In the same way, the negative polarity D/A converter 22 executes the D/A conversion of the digital video signals, and then outputs the m to the analog video buses as analog signals of the negative polarity relative to the reference voltage.

The positive polarity D/A converter 21 is composed of a D/A converter portion 211, an output buffer 212, a first switch circuit 213 corresponding to a first output selector portion, a second switch circuit 214 corresponding to a second output selector portion, and a clock monitoring circuit 215. A power supply potential (Vdd) of +10 V corresponding to a first voltage and a ground potential (Vss) of +5 V corresponding to a second voltage are input from the external side.

The negative polarity D/A converter 22 is composed of a D/A converter portion 221, an output buffer 222, a first switch circuit 223 corresponding to the first output selector portion, a second switch circuit 224 corresponding to the second output selector portion, and a clock monitoring circuit 225. A power supply potential (Vdd) of +5 V corresponding to the second voltage and a ground potential (Vss) of 0 V (GND) corresponding to a third voltage are input from the external side.

When the digital video signals and the horizontal clock signal CKH are input from the control IC 103 (FIG. 3) to the positive polarity D/A converter 21 and the negative polarity D/A converter 22, the D/A converter portions 211, 221 of respective D/A converters 21, 22 sample- hold the video signals in synchronism with the horizontal clock signal CKH, then convert them into the analog signals, and then output them to the output buffers 212, 222. After this, the analog signals are output from the output buffers 212, 222 to the liquid crystal panel via the second switch circuits 214, 224.

Since the same horizontal clock signal CKH is input into both the positive polarity D/A converter 21 and the negative polarity D/A converter 22, the horizontal clock signal CKH may be monitored by any one of the clock monitoring circuits 215, 225. In the D/A converter 20 shown in FIG. 10, the circuit is so constructed that the horizontal clock signal CKH can be monitored by the positive polarity D/A converter 21 and the negative polarity D/A converter 22 respectively.

The first switch circuit 213 of the positive polarity D/A converter 21 is a switch circuit which outputs one of two inputs, i.e., the power supply potential (Vdd) of +10 V and the ground potential (Vss) of +5 V. Input selection in the first switch circuit 213 can be set by a connection position of a setting terminal 216. Two terminals (not shown) for the power supply potential (Vdd) and the ground potential (Vss) are prepared as the setting terminal 216. In the positive polarity D/A converter 21, the first switch circuit 213 is connected to the setting terminal 216 for the ground potential (Vss). Accordingly, the ground potential (Vss) of +5 V is output from the first switch circuit 213.

While, the first switch circuit 223 of the negative polarity D/A converter 22 is a switch circuit which outputs one of two inputs, i.e., the power supply potential (Vdd) of +5 V and the ground potential (Vss) of 0 V. Two terminals (not shown) for the power supply potential (Vdd) and the ground potential (Vss) are prepared in the first switch circuit 223. Input selection in the first switch circuit 223 can be set by a connection position of a setting terminal 226. In the negative polarity D/A converter 22, the first switch circuit 223 is connected to the setting terminal 226 for the power supply potential (Vdd). Accordingly, the power supply potential (Vdd) of +5 V is output from the first switch circuit 223.

The second switch circuit 214 of the positive polarity D/A converter 21 is a switch circuit which selects one of two inputs, i.e., the analog signal output which is output from the output buffer 212 and the ground potential which is the output of the first switch circuit 213 and outputs it. Input selection in the second switch circuit 214 is controlled by the output of the clock monitoring circuit 215. During when the horizontal clock signal CKH is being regularly input into the D/A converter 20, the analog signal output is selected as an input according to the control signal from the clock monitoring circuit 215. In contrast, when the horizontal clock signal CKH is in a non-conformity state, for instance, the ground potential of +5 V is selected as an input according to the control signal from the clock monitoring circuit 215.

The second switch circuit 224 of the negative polarity D/A converter 22 is a switch circuit which selects one of two inputs, i.e., the analog signal output which is output from the output buffer 222 and the Power supply potential which is the output of the first switch circuit 223 and outputs it. Input selection in the second switch circuit 224 is controlled by the output of the clock monitoring circuit 225. During when the horizontal clock signal CKH is being regularly input into the D/A converter 20, the analog signal output is selected as an input according to the control signal from the clock monitoring circuit 225. In contrast, when the horizontal clock signal CKH is in a non-conformity state, for instance, the power supply potential of +5 V is selected as an input according to the control signal from the clock monitoring circuit 225.

Like the embodiment 1, the common circuit 23 electrically connected to the opposing electrode is composed of a current amplifier portion 231 consisting of the Pch-transistor and the resistor, an operational amplifier 232 for supplying a predetermined voltage to the current amplifier portion 231, and a switch circuit 233 connected to the input side of the operational amplifier 232. The current amplifier portion 231 of the common circuit 23 is connected to +10 V and ground (GND). The switch circuit 233 selects one of two inputs, i.e., the DC common control voltage (Vc) which is divided for resistance between +10 V and ground and the voltage of +5 V which is the same as one of respective input voltages of the positive polarity D/A converter 21 and the negative polarity D/A converter 22, and then outputs it. Input selection in the switch circuit 233 is controlled by the control signal being output from the clock monitoring circuit 225 of the negative polarity D/A converter 22.

While the horizontal clock signal CKH is input into the D/A converter 20, the common control voltage (Vc) is selected as an input in the switch circuit 233 according to the control signal from the clock monitoring circuit 225. In contrast, when the horizontal clock signal CKH is in a non-conformity state, the power supply potential of +5 V is selected as an input according to the control signal from the clock monitoring circuit 225.

In turn, an operation of the D/A converter 20 constructed as above will be explained hereunder.

The clock monitoring circuits 215, 225 of the positive polarity D/A converter 21 and the negative polarity D/A converter 22 monitor the states of the horizontal clock signal CKL During when the horizontal clock signal CKH is being regularly input, the clock monitoring circuit 215, 225 output the control signal such that the analog signal output is selected as inputs of the second switch circuits 214 and 224. At the same time, the common control voltage (Vc) is selected as an input in the switch circuit 233 of the common circuit 23 according to this control signal.

Meanwhile, when the horizontal clock signal CKH is in a non-conformity state, for instance, the clock monitoring circuits 215, 225 operate in the following. The clock monitoring circuit 215 outputs the control signal such that the ground potential of +5 V is selected as the input of the second switch circuits 214. Also, when inputting of the horizontal clock signal CKH is in a non-conformity state, for instance, the clock monitoring circuits 225 outputs the control signal such that the power supply potential of +5 V is selected as the input of the second switch circuits 224. As a result, both outputs of the positive polarity D/A converter 21 and the negative polarity D/A converter 22 become +5 V together. At the same time, the voltage of +5 V which is the external input is selected as an input according to the control signal from the clock monitoring circuits 225 in the switch circuit 233 of the common circuit 23. As a consequence, an output (Vcom) of the common circuit 23 becomes +5 V, like the outputs of two D/A converters 21, 22.

According to the above driving circuit, since both the output voltage of the D/A converter and the common voltage can be set to the same voltage (+5 V) when the horizontal clock signal CKH is in a non-conformity state, the DC voltage can be prevented from being applied to the liquid crystal.

In the D/A converter 20 according to the embodiment 2, since the number of terminals provided on the output side can be reduced in structure, the number of output wirings which are drawn on the circuit board can be reduced.

In the embodiment 2, like the embodiment 1, a configuration in which the switch circuit 233 is omitted may also be adopted. Input selection in the switch circuit 233 of the common circuit 23 may be controlled according to the control signal of the clock monitoring circuit 215 in the positive polarity D/A converter 21.

In the embodiment 1 and the embodiment 2 mentioned above, since the clock monitoring circuits are built in the positive polarity D/A converter and the negative polarity D/A converter respectively, the number of parts can be reduced rather than the conventional D/A converter in which the clock monitoring circuits are provided externally and independently. In addition, since the IC chips having the same configuration and the same breakdown voltage can be employed as both the positive polarity D/A converter and the negative polarity D/A converter, lower cost can be expected in mass production.

The above embodiments have been explained while taking as examples the case where the common circuit for outputting the DC voltage is employed. But, as shown in FIG. 9(B), the common circuit in which the polarity inversion is carried out at a predetermined period with respect to the reference voltage may be employed.

Figure 9B:
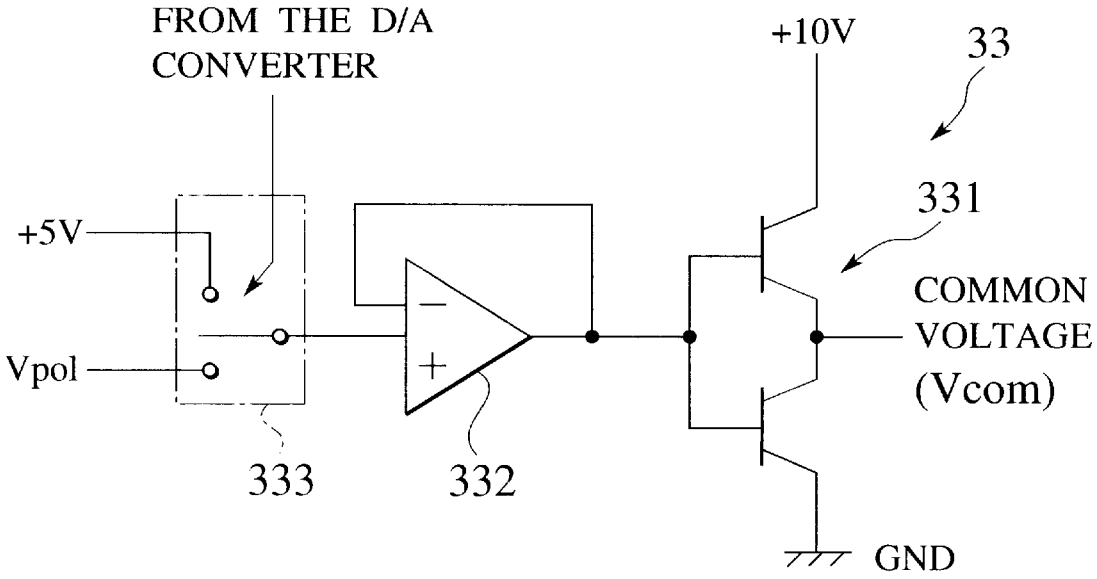

The common circuit 33 shown in FIG. 9B comprises a current amplifier portion 331 which includes a push-pull circuit consisting of a pair of series-connected transistors, an operational amplifier 332 for supplying a predetermined voltage to the current amplifier portion 331, and a switch circuit 333 which is connected to the input side of the operational amplifier 332. The current amplifier portion 331 of the common circuit 33 is connected to +10 V and ground (GND). The switch circuit 333 selects one of two inputs, i.e., the polarity inversion signal (Vpol) having an amplitude of 3V and the voltage of +5 V which is the same as one of respective input voltages of the positive polarity D/A converter and the negative polarity D/A converter, both not shown, and then outputs it. Like the above embodiments, this input selection can be controlled by the control signal which is output from the clock monitoring circuit of the negative polarity D/A converter, for example.

According to this common circuit 33, during when the horizontal clock signal CKH is being input to the D/A converter, the polarity inversion signal (Vpol) is selected as an input by the control signal supplied from the clock monitoring circuit, and then the AC common voltage (Vcom) having a 5 V amplitude is output based on the above situation. On the contrary, when the horizontal clock signal CKH is in a non-conformity state, for instance, the power supply potential of +5 V is selected as an input according to the control signal supplied from the clock monitoring circuit, and then the DC common voltage (Vcom) of +5 V is output based on the above situation.

As a result, even if the common circuit shown in FIG. 9B is employed in combination, the similar advantages to those in the above embodiments can be achieved.

What is claimed is:

1. A flat panel display device comprising:

a display panel having display pixels each of which includes a pixel electrode, an opposing electrode, and an optical modulation layer interposed between these electrodes;

a first D/A converter circuit for receiving a first digital video signal, a clock signal, a first voltage, and a second voltage lower than the first voltage, and converting the first digital video signal into a first analog video signal based on the clock signal;

a second D/A converter circuit for receiving a second digital video signal, the clock signal, the second voltage, and a third voltage lower than the second voltage, and converting the second digital video signal into a second analog video signal based on the clock signal;

a driving control portion for outputting the first and second digital video signals and the clock signal to the first D/A converter circuit and the second D/A converter circuit; and a driving circuit portion for outputting signal voltages to respective pixel electrodes in the display panel based on the first analog video signal and the second analog video signal;

wherein the first D/A converter circuit and the second D/A converter circuit have a same circuit configuration which includes a clock monitoring portion for monitoring the clock signal, and an output selector portion for setting both the first analog video signal and the second analog video signal to a predetermined voltage based on an output of the clock monitoring portion.

2. A flat panel display device according to claim 1, wherein the predetermined voltage is an intermediate voltage between first and third voltages.

3. A flat panel display device according to claim 2, wherein the intermediate voltage is the second voltage.

4. A flat panel display device according to claim 2, further comprising:

an opposing electrode driving circuit for supplying the voltage to opposing electrodes, based on the output of the clock monitoring portion which is contained in any one of the first D/A converter circuit and the second D/A converter circuit.

5. A flat panel display device according to claim 4, wherein the opposing electrode driving circuit supplies a substantial second voltage to the opposing electrodes, based on the output of the clock monitoring portion which is contained in any one of the first D/A converter circuit and the second D/A converter circuit.

6. A flat panel display device according to claim 1, wherein both output selector portions in the first D/A converter circuit and the second D/A converter circuit are controlled respectively, based on any one of outputs of clock monitoring portions in the first D/A converter circuit and the second D/A converter circuit.

7. A flat panel display device according to claim 1, wherein the output selector portion in the first D/A converter circuit includes a first output selector portion for outputting one of the first voltage and the second voltage, and a second output selector portion for setting the first analog video signal to an output of the first output selector portion based on the output of the clock monitoring portion, the output selector portion in the second D/A converter circuit includes a first output selector portion for outputting one of the second voltage and the third voltage, and a second output selector portion for setting the first analog video signal to an output of the first output selector portion based on the output of the clock monitoring portion, and the second output selector portion in the first D/A converter circuit is controlled based on the output of the clock monitoring portion in the first D/A converter circuit, and the second output selector portion in the second D/A converter circuit is controlled based on the output of the clock monitoring portion in the second D/A converter circuit.

8. A flat panel display device according to claim 7, wherein the first D/A converter circuit and the second D/A converter circuit comprise setting terminals for setting outputs in the first output selector portions respectively.

9. A flat panel display device according to claim 1, wherein the clock signal which is output from the driving control portion to the first D/A converter circuit and the second D/A converter circuit is a horizontal clock signal.

10. A flat panel display device according to claim 9, wherein the driving control portion generates the horizontal clock signal based on a reference clock signal supplied from an external device.

11. A flat panel display device according to claim 1, wherein the driving circuit portion is integrated in the display panel.

12. A flat panel display device according to claim 5, wherein the opposing electrode driving circuit receives the second voltage or a common control voltage.

13. A flat panel display device according to claim 11, wherein the driving control portion includes a analog video bus line for transmitting the first analog video signal and the second analog video signal, a shift register, and a sampling means for sampling the first analog video signal or the second analog video signal based on an output of the shift register.

14. A flat panel display device according to claim 13, wherein polysilicon is employed as a semiconductor layer constituting the driving circuit portion.

15. A flat panel display device according to claim 1, wherein the driving control portion includes a memory means for storing the digital video signal, and a selectively outputting means for selectively outputting the stored digital video signal to the first D/A converter circuit and the second D/A converter circuit.

* * * * *